US011480036B2

(12) United States Patent
Pace

(10) Patent No.: US 11,480,036 B2
(45) Date of Patent: Oct. 25, 2022

(54) LINER HANGER WITH A TEST PACKER FOR WELLBORE OPERATIONS

(71) Applicant: Halliburton Energy Services, Inc., Houston, TX (US)

(72) Inventor: Alan Pace, Aberdeenshire (GB)

(73) Assignee: Halliburton Energy Services, Inc., Houston, TX (US)

( * ) Notice: Subject to any disclaimer, the term of this patent is extended or adjusted under 35 U.S.C. 154(b) by 54 days.

(21) Appl. No.: 16/551,086

(22) Filed: Aug. 26, 2019

(65) Prior Publication Data

US 2021/0062622 A1 Mar. 4, 2021

(51) Int. Cl.

| | |
|---|---|
| ***E21B 43/10*** | (2006.01) |
| ***E21B 34/06*** | (2006.01) |
| ***E21B 33/12*** | (2006.01) |
| ***E21B 47/06*** | (2012.01) |

(52) U.S. Cl.

CPC ..... *E21B 43/10* (2013.01); *E21B 33/12* (2013.01); *E21B 34/06* (2013.01); *E21B 47/06* (2013.01)

(58) Field of Classification Search

CPC ..... E21B 43/10; E21B 33/12

See application file for complete search history.

(56) References Cited

U.S. PATENT DOCUMENTS

| | | | | |
|---|---|---|---|---|
| 4,154,298 A | | 5/1979 | Gano | |
| 5,884,702 A | | 3/1999 | Yokley et al. | |
| 5,887,660 A | * | 3/1999 | Yokley | E21B 23/06 166/185 |
| 2003/0201102 A1 | | 10/2003 | Mackenzie et al. | |
| 2011/0203794 A1 | * | 8/2011 | Moffitt | E21B 33/13 166/285 |
| 2012/0175108 A1 | | 7/2012 | Foubister et al. | |
| 2012/0325499 A1 | * | 12/2012 | Moffitt | E21B 23/06 166/382 |
| 2019/0128115 A1 | * | 5/2019 | AlNughaimish | E21B 43/10 |

FOREIGN PATENT DOCUMENTS

| | | |
|---|---|---|
| CN | 205592561 | 9/2016 |

OTHER PUBLICATIONS

PCT Application No. PCT/US2019/048131 , "International Search Report and Written Opinion", dated May 25, 2020, 10 pages.

* cited by examiner

*Primary Examiner* — Sean D Andrish
(74) *Attorney, Agent, or Firm* — Kilpatrick Townsend & Stockton LLP

(57) ABSTRACT

Certain aspects and examples of the present disclosure relate to an assembly for positioning a liner hanger and conducting a test on the liner hanger in the same trip downhole. The assembly can include a liner hanger, a setting control module, a test packer, and a stop. The setting control module can control a setting for the test packer. The test packer can be positioned with the liner hanger in the wellbore to allow a negative-pressure-test on liner hanger on the same trip downhole in which the liner hanger is set. The stop can engage with the liner hanger to allow the setting control module to control the test packer.

17 Claims, 5 Drawing Sheets

LINER HANGER WITH A TEST PACKER FOR WELLBORE OPERATIONS

TECHNICAL FIELD

The present disclosure relates generally to devices for use in a wellbore in a subterranean formation and, more particularly (although not necessarily exclusively), to installing and testing packers in a wellbore.

BACKGROUND

Devices can be used in a well that traverses a hydrocarbon-bearing subterranean formation for a variety of purposes in connection with completing a wellbore for producing hydrocarbon fluid from the subterranean formation. An example of a device is a liner hanger, which can allow a liner (e.g., casing extending downhole from the liner hanger) to be suspended in the previous casing string to reduce material costs and provide completion solution options. A liner hanger can be run downhole to a desired position and then cemented. A second trip downhole is performed to implement tests, such as a positive-pressure-test and a negative-pressure-test, on the liner hanger, prior to performing subsequent completion steps.

DETAILED DESCRIPTION

Figure 1:
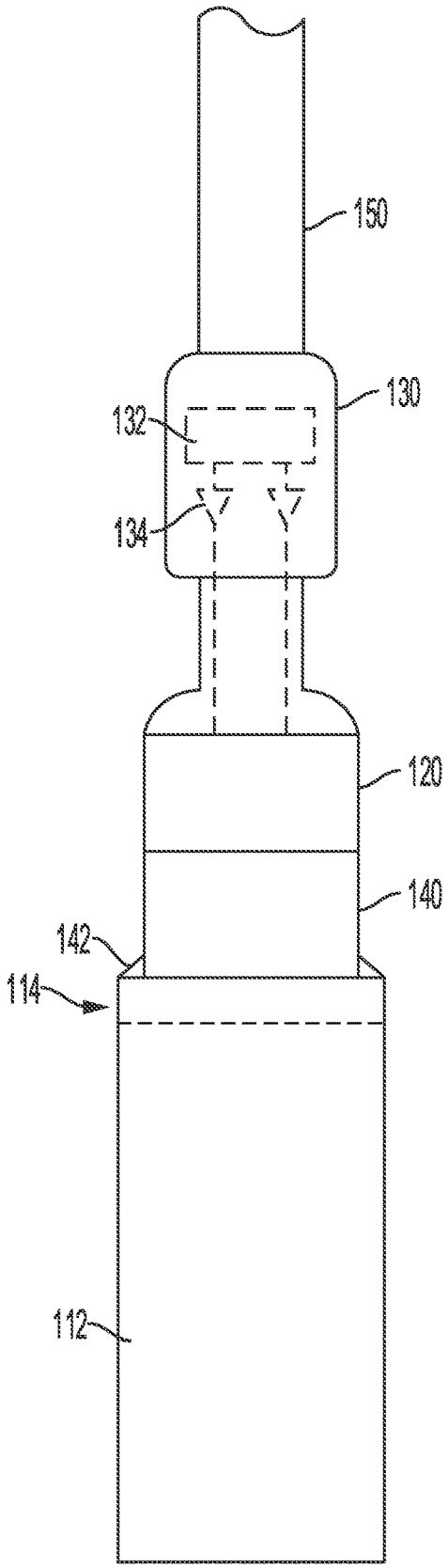
FIG. 1 is a test packer and liner hanger according to some aspects of the present disclosure.

Certain aspects and examples of the present disclosure relate to a liner hanger and test packer for installing and implementing tests on the liner hanger in a wellbore the same trip in the wellbore by using a setting control module. The same trip may involve a single trip in the wellbore can include running equipment via a conveyance into the wellbore, performing the desired operations using the equipment, and then removing at least some of the equipment via the conveyance from the wellbore. The setting control module can be run with the liner hanger and the test packer, and can be used to set the test packer to allow for the tests on the liner hanger to be performed. The test packer can be used to implement tests that include a positive-pressure-test and a negative-pressure-test. In a positive-pressure-test, the setting control module can set the test packer to allow for the area above the packer to be pressurized. In a negative-pressure-test, a pressure differential on each side of the packer can be created and the liner with the liner hanger can be tested for leaks. By using a setting control module to set and control the test packer, a single trip can be used to run the liner hanger downhole with the test packer to avoid performing multiple trips for setting the liner hanger and performing tests.

Generally, completing a negative-pressure-test on the liner top can be achieved with a separate run including a test packer providing a barrier in the event of an influx of hydrocarbons. However, the present disclosure describes a test packer and a setting control module that can be run down a wellbore in the same string as liner hanger running tools and a stop. A liner hanger can be installed in the wellbore using the liner hanger running tools. The stop can allow weight to be applied to the liner top, setting the test packer and allowing a negative-pressure-test to be completed. The test packer can allow well control to be completed safely without hydrocarbons reaching the wellhead. The test packer can be used to implement tests including a negative-pressure-test and a positive-pressure-test. The stop can be a tool, for example a packer actuator, with spring-loaded devices designed to match the angle of the liner top. After the liner hanger has been set, the stop can be pulled above the liner top, allowing the spring-loaded devices to deploy. The stop can be lowered and the spring-loaded devices can engage with the liner top to provide a stop point for the test packer. The stop point can be used to set the test packer against the liner top. After being set against the liner top, the test packer can be used to complete a negative-pressure-test on the liner top. The test packer can hold 8,000 psi differential pressure at 350 degrees Fahrenheit (177 degrees Celsius). Fluid used in the negative-pressure-test can be circulated past the test packer up to 30 bbls per minutes. After the negative-pressure-test is completed, the test packer can be unset and the setting control module, test packer, and stop can be removed from the wellbore.

Combining the test packer in a liner hanger running string to achieve the negative test in the same operation as the liner hanger running and setting can save time and money. Such a system may be used in combined liner running and clean-ups, but also to provide the ability for a packer-controlled negative test after a liner hanger run.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a test packer and liner hanger assembly 100 according to some aspects of the present disclosure. The assembly 100 can include a liner hanger 110 and components for hanging a liner 112 in a wellbore and for implementing various tests on the liner hanger 110. The components can include a test packer 120, a setting control module 130, and a stop 140. The components of the assembly 100 can be coupled and run into a wellbore via a conveyance 150.

The liner hanger 110 can be used to couple or hang a liner 112 from an internal wall of a casing that has been previously set in a wellbore. The casing can include a liner hanger 110 and a liner 112 that was set in the wellbore in the same or a previous run. The liner 112 can stabilize the wellbore and prevent the wall of the wellbore from caving into the wellbore. In some examples, the liner 112 is cemented in place in the wellbore after being hung from the previous casing. The liner hanger 110 can include slips or expandable sections for attaching to the internal wall of the previous casing. The top of the liner hanger 110 can include an engagement device 114 for engaging with the stop 140. In some examples, the engagement device 114 is a polished bore receptacle (PBR) or a tieback receptacle (TBR).

The test packer 120 can be used to test that the liner hanger 110 has been properly set in the wellbore. The test packer 120 can be positioned in the wellbore uphole from the liner hanger 110 and expanded to engage with the inner walls of the previously set casing. The test packer 120 can be set against the liner hanger 110 by the setting control module 130.

The test packer 120 can be coupled with the stop 140 to aid in setting the test packer 120 against the liner hanger 110. The stop 140 can engage with the engagement device 114, allowing the conveyance 150 to slack weight onto the liner hanger 110 without causing damage to the liner hanger 110. The stop 140 can include spring-loaded devices 142 for engaging with the liner hanger 110 at the engagement device 114. In some examples, the stop 140 can be a packer actuator.

The setting control module 130 can include a fluid reservoir 132 for receiving fluid and one or more valves 134 for controlling the flow of fluid from the fluid reservoir 132. The setting control module 130 can also be referred to as an SCM. The valves 134 can be set to a threshold pressure and prevent fluid from leaving the fluid reservoir 132 until the threshold pressure has been reached. In some examples, the valves 134 are one-way valves.

The setting control module 130 can be used to set the test packer 120 by expanding the test packer 120 until it engages with the inner walls of the previous casing. The slack-off weight of the conveyance 150 can be used to increase the pressure in the fluid reservoir 132. When the pressure in the fluid reservoir 132 has reached the threshold pressure, the valves 134 can open, allowing fluid to flow from the fluid reservoir 132 to the test packer 120. The test packer 120 can be unset by removing the slack-off weight from the setting control module 130. Removing the slack off weight can decrease the pressure in the fluid reservoir 132 below the threshold value. Unsetting the test packer 120 can additionally or alternatively reset the setting control module 130. When the setting control module 130 is reset, the valves prevent the fluid from traveling to the test packer 120 until the pressure in the fluid reservoir 132 has been reached or exceeded. The setting control module 130 can set (i.e., expand) the test packer 120 multiple times in a single run.

The test packer 120 can be used to form a seal uphole from the liner hanger 110 and run a negative-pressure-test and a positive-pressure-test on the liner hanger 110. The negative-pressure-test and positive-pressure-test can be run in a single trip in the wellbore. In the positive-pressure-test, an area above the test packer 120 can be pressurized to test the seal between the test packer 120 and the inner wall of the previous casing. The area above the test packer 120 can be pressurized using fluid pumped down an annulus formed between the casing and the wellbore. In the negative-pressure-test, the liner 112 and liner hanger 110 can be tested for leaks by creating a pressure differential on each side of the test packer 120. The pressure differential can be created by pumping displacement fluid, such as oil, from the head of the wellbore to a point downhole from the test packer 120.

The conveyance 150 can couple the components of the assembly 100 and be used to run the assembly 100 into a wellbore in a single trip. And the negative-pressure-test and positive-pressure-test can be performed on the same trip as setting the liner hanger 110. Running the assembly 100 into the wellbore in the same run the negative-pressure-test is implemented can reduce costs and the time required for setting and testing the liner hanger 110. The conveyance 150 can be a running string used in wellbore completions. For example, the conveyance 150 can be a wireline or coiled tubing. In some examples, the conveyance 150 can include running tools 152 for transporting the liner 112 into the wellbore.

FIGS. 2 to 5 depict the assembly 100 of FIG. 1 at different configurations in a wellbore environment according to some aspects of the present disclosure. Together, FIGS. 2 to 5 illustrate a process that can be implemented for installing and testing a liner hanger in a wellbore with a test packer via a single trip in the wellbore using a setting control module. Some examples can include more, fewer, or different steps than the steps shown in FIGS. 2 to 5. FIGS. 2 to 5 are discussed with reference to the components of FIG. 1, but other implementations are possible.

Figure 2:
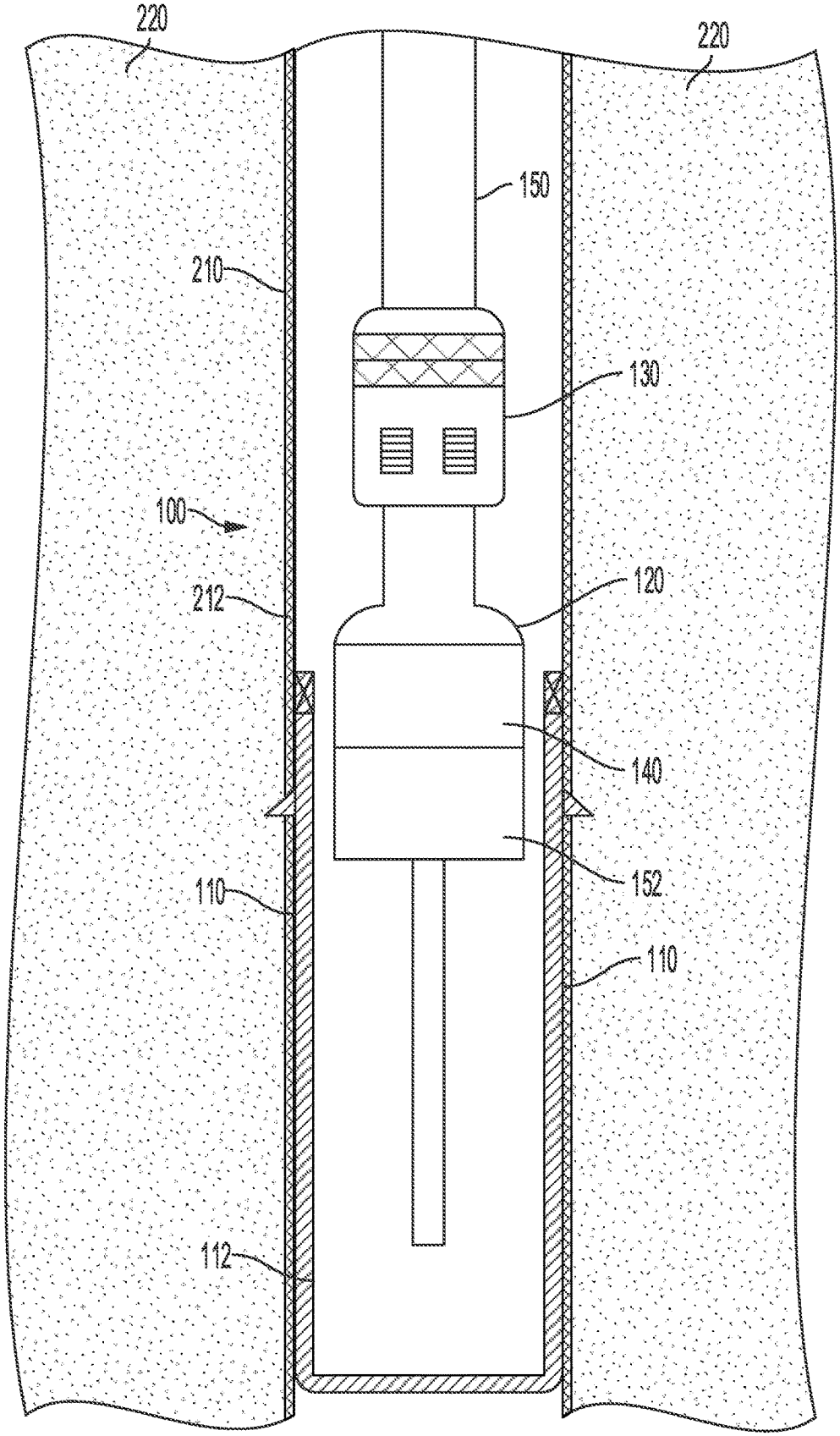
FIG. 2 is a cross-sectional view of a wellbore with the test packer and liner hanger of FIG. 1 in a run-in-hole configuration according to some aspects of the present disclosure.

FIG. 2 is a cross-sectional schematic view of the assembly 100 of FIG. 1 in a run-in-hole configuration according to some aspects of the present disclosure. In the run-in-hole configuration, a conveyance 150, including running tools 152, is connected to the assembly 100 and run downhole into the wellbore 210 extending through various earth strata that form a subterranean formation 220. The assembly 100 includes a liner hanger 110, a liner 112, a test packer 120, a setting control module 130, and a stop 140. The conveyance 150 and assembly 100 can be run downhole to a position where the liner 112 can be set. The running tools 152 and the liner hanger 110 can be used to hang the liner 112 in position in the wellbore 210. For example, the liner 112 can be set to overlap with a previous casing 212 in the wellbore 210. In some examples, the liner 112 is cemented into place after being set in position.

Figure 3:
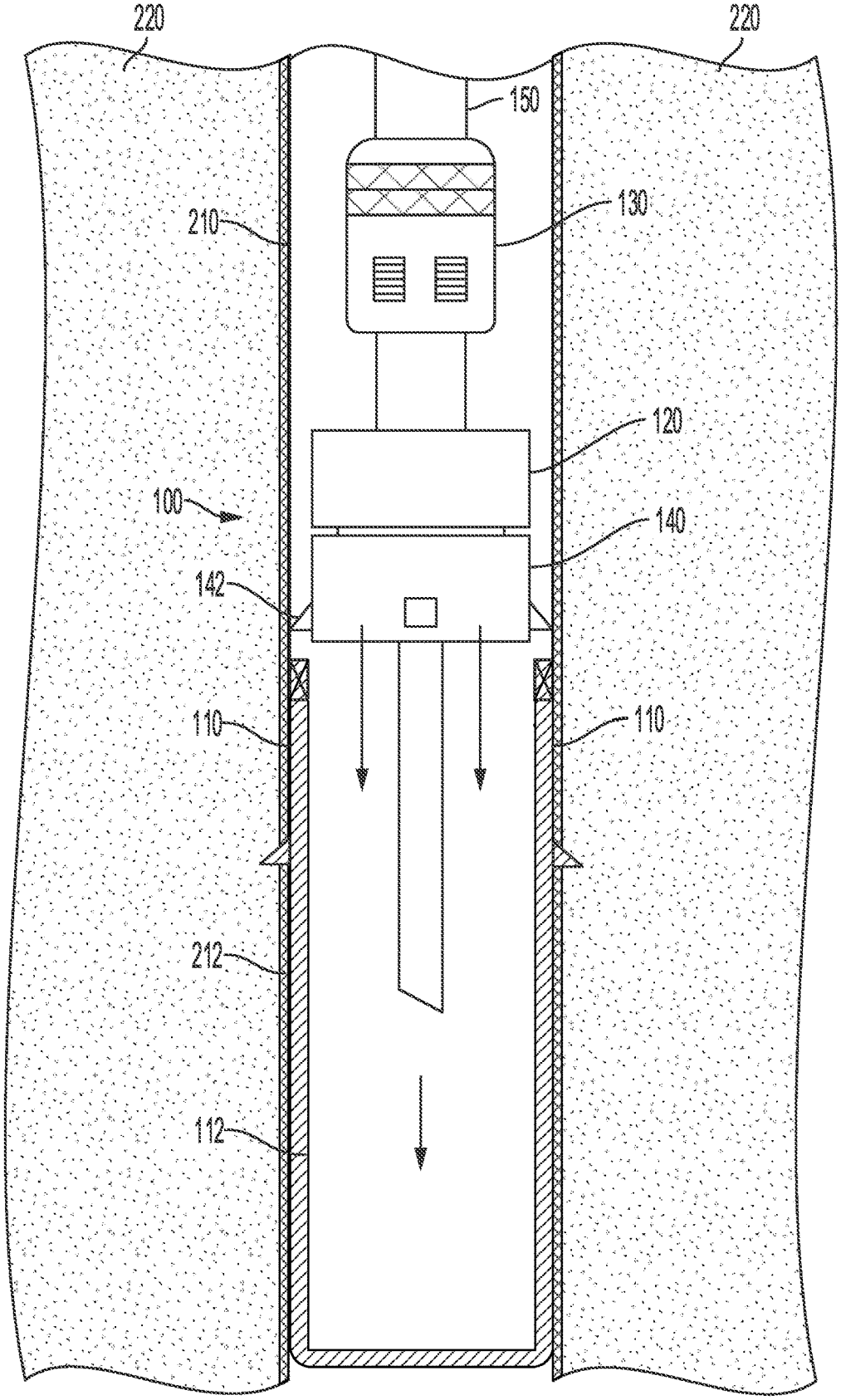
FIG. 3 is a cross-sectional view of a wellbore with the test packer and liner hanger of FIG. 1 in a positive-pressure-test configuration according to some aspects of the present disclosure.

FIG. 3 is a cross-sectional schematic view of the assembly 100 of FIG. 1 in a positive-pressure-test configuration according to some aspects of the present disclosure. In the positive-pressure-test configuration, the test packer 120 can be engaged with the interior walls of the casing 212 allowing for pressure to be increased above the test packer 120. The conveyance 150, test packer 120, setting control module 130, and stop 140 can be raised uphole and the spring-loaded devices 142 can be moved from a storage configuration, where the spring-loaded devices 142 are contained inside the stop 140, to a deployed configuration, where the spring-loaded devices 142 are external to the stop 140. The conveyance 150 can move the test packer 120, the setting control module 130, and the stop 140 downhole until the spring-loaded devices 142 engage with the engagement device 114. When the spring-loaded devices 142 are engaged with the engagement device 114, the stop 140 can allow the test packer 120 to be set against the liner hanger 110. For example, the spring-loaded devices 142 can match the angle of the interior walls of the engagement device 114. The test packer 120 can be set by slacking the weight of the conveyance 150 onto the liner hanger 110. Slacking the weight of the conveyance 150 can allow the setting control module 130 to set the test packer 120 by increasing the pressure in the fluid reservoir 132 until a threshold pressure is reached or surpassed. When the threshold pressure has been reached, the valves 134 can allow the fluid to flow from the fluid reservoir 132 to the test packer 120, expanding the test packer 120 until the test packer 120 engages with the inner sidewalls of the casing 212, forming a seal. The positive-pressure-test can be implemented to test the seal formed between the test packer 120 and the casing 212. The positive-pressure-test can be implemented by increasing the pressure on the area uphole from the test packer 120. The pressure above the test packer 120 can be increased by pumping fluid from the head of the wellbore 210 down an annulus between the casing 212 and the wellbore 210. After the positive-pressure-test has been implemented, the conveyance 150 can position the assembly 100 in a negative-pressure-test configuration where the test packer 120 is engaged with the inner walls of the casing 212 and a pressure differential can be created on each side of the test packer 120. The conveyance 150 can lift the slacked weight off the liner hanger 110, disengaging the test packer 120 from the inner walls of the casing 212. Un-slacking the weight off the liner hanger 110 can additionally or alternatively reset the setting control module 130 by decreasing the pressure in the fluid reservoir 132 below the threshold value. The valves can then prevent the fluid from traveling to the test packer 120 until the pressure in the fluid reservoir 132 has been reached or exceeded. The stop 140 can be lifted above the liner hanger 110 until the spring-loaded devices 142 are no longer engaged with the engagement device 114.

Figure 4:
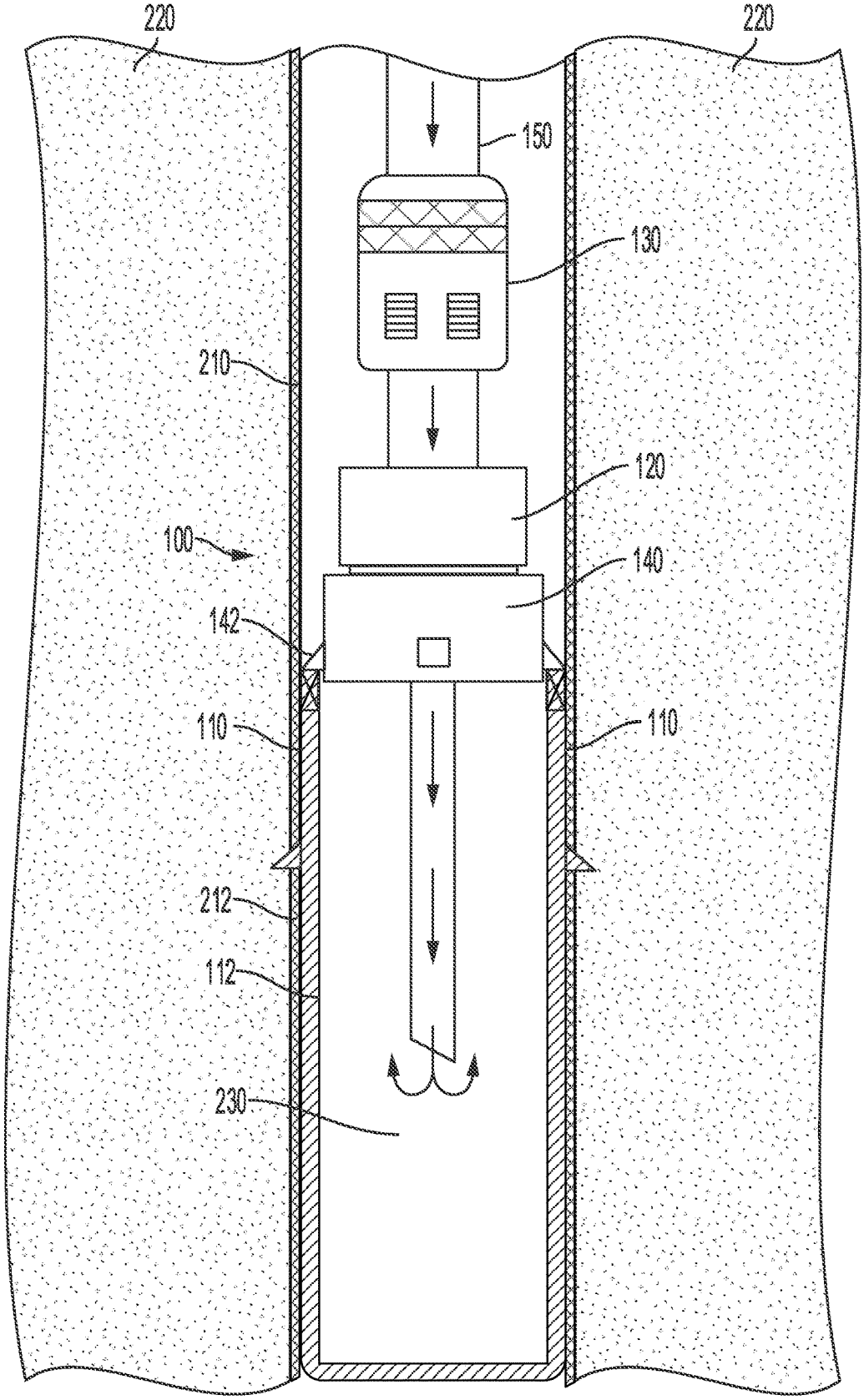
FIG. 4 is a cross-sectional view of a wellbore with the test packer and liner hanger of FIG. 1 in a negative-pressure-test configuration according to some aspects of the present disclosure.

FIG. 4 is a cross-sectional schematic view of the assembly 100 of FIG. 1 in a negative-pressure-test configuration according to some aspects of the present disclosure. In the negative-pressure-test configuration, the test packer 120 can be engaged with the inner walls of the casing 212 and a pressure differential can be created on each side of the test packer 120. The negative-pressure-test can include pumping displacement fluid 230 from the wellhead down the conveyance 150. The displacement fluid 230 can be pumped downhole past the test packer 120. For example, the displacement fluid 230 can be circulated past the test packer 120 up to 30 bbls per minute (1260 gallons per minute). The displacement fluid 230 can have a lighter density than the wellbore fluid, causing the wellbore fluid above the displacement fluid 230 to flow uphole. The spring-loaded devices 142 can re-engage with the engagement device 114. The setting control module 130 can set the test packer 120 to engage with the inner walls of the casing 212 and form a seal between the test packer 120 and the casing 212. The displacement fluid 230 located downhole from the test packer 120 and the wellbore fluid located uphole from the test packer 120 can create a pressure differential on each side of the test packer 120. For example, there can be a pressure differential of 8,000 psi (55,158,080 Pascal's) at 350 degrees Fahrenheit (177 degrees Celsius). This pressure differential can be used to test for leaks in the liner hanger 110 and liner 112. After completing the negative-pressure-test, the assembly 100 can be moved to a trip-out configuration for removal from the wellbore 210.

Figure 5:
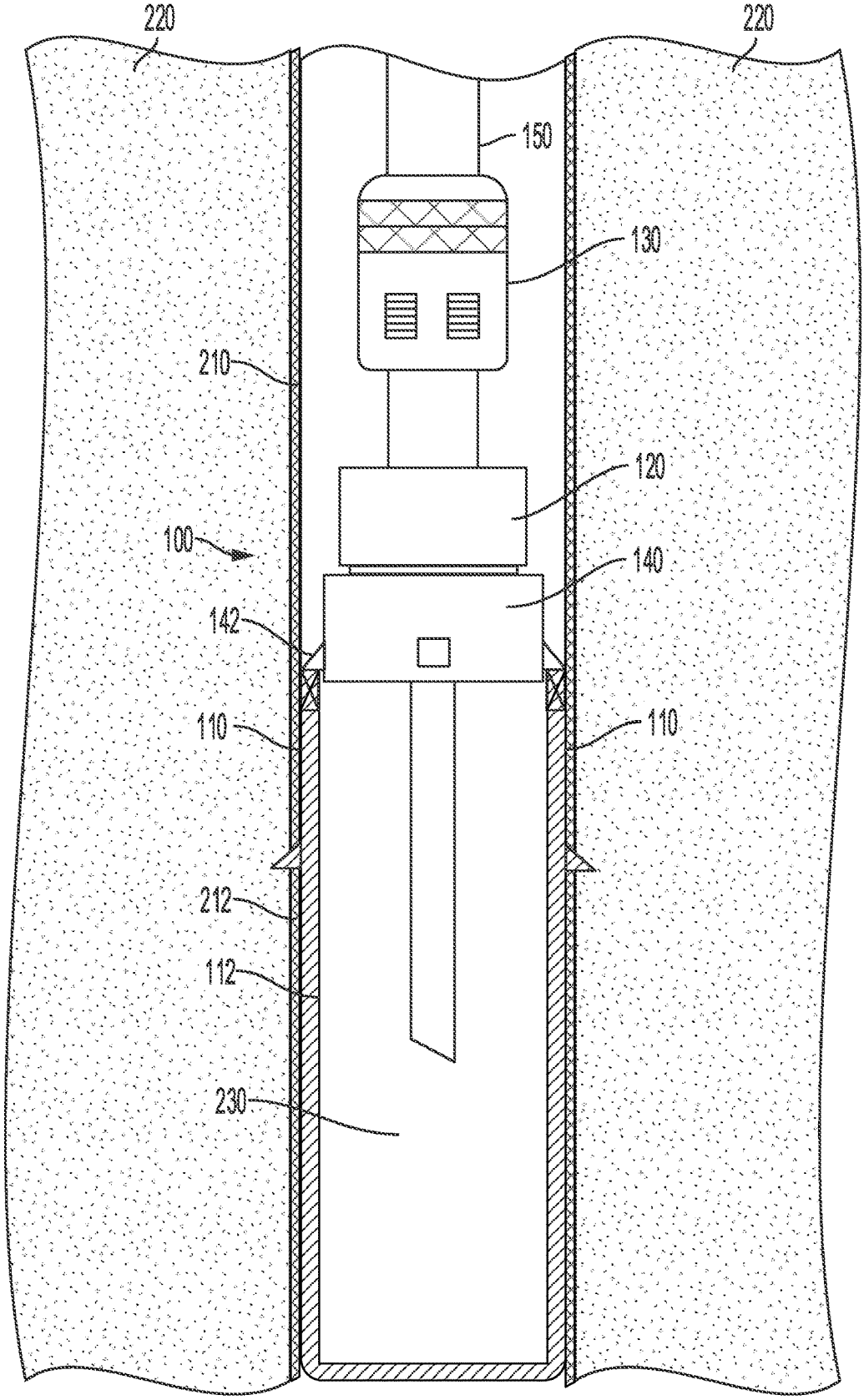
FIG. 5 is a cross-sectional view of a wellbore with the test packer and liner hanger of FIG. 1 in a trip-out configuration according to some aspects of the present disclosure.

FIG. 5 is a cross-sectional schematic view of the assembly 100 of FIG. 1 in a trip-out configuration according to some aspects of the present disclosure. The test packer 120, setting control module 130, and stop 140 are ready to be removed from the wellbore 210. The displacement fluid 230 can be removed from the wellbore 210 to equalize the pressure on each side of the test packer 120. The conveyance 150 can un-slack the weight from the liner hanger 110, disengaging the test packer 120. The conveyance 150 can pull the test packer 120, setting control module 130, and stop 140 uphole and out of the wellbore 210. Additional completion operations can then be implemented on the wellbore 210.

In some aspects, apparatuses and a method for a liner hanger with a test packer are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is an assembly comprising: a liner hanger; a setting control module to control a setting for a test packer; the test packer positionable with the liner hanger in a wellbore to allow a negative-pressure-test on the liner hanger on the same trip downhole in which the liner hanger is set; and a stop to engage with the liner hanger to allow the setting control module to control the test packer.

Example 2 is the assembly of example(s) 1, wherein the stop includes spring-loaded devices moveable from a retracted position at which the spring-loaded devices are contained within the stop, to an engagement position at which a portion of the spring-loaded devices are external to the stop.

Example 3 is the assembly of example(s) 1, wherein the liner hanger comprises a polished bore receptacle (PBR) or a tieback receptacle (TBR) for engaging with the stop.

Example 4 is the assembly of example(s) 1, wherein the setting control module comprises: a fluid reservoir for receiving a volume of fluid; and one or more valves set to a threshold pressure to prevent fluid from exiting the fluid reservoir when the fluid reservoir is at a pressure below the threshold pressure.

Example 5 is the assembly of example(s) 4, further comprising a conveyance coupled with the setting control module, wherein a weight of the conveyance is usable to increase the pressure in the fluid reservoir.

Example 6 is the assembly of example(s) 4, wherein the one or more valves are operable to allow fluid from the fluid reservoir to travel to the test packer in response to the pressure in the fluid reservoir being at or above the threshold pressure.

Example 7 is the assembly of example(s) 1, wherein the test packer is expandable to engage with interior walls of a casing and to form a seal subsequent to the liner hanger being set in the wellbore to allow the negative-pressure-test on the liner hanger on the same trip downhole in which the liner hanger is set.

Example 8 is the assembly of example(s) 1, further comprising running tools for positioning the liner hanger in the wellbore to allow the negative-pressure-test on the liner hanger on the same trip downhole in which the liner hanger is set.

Example 9 is a method comprising: setting a liner hanger in a wellbore using a conveyance on which a setting control module and a test packer are coupled; allowing the setting control module to control the test packer by a stop engaging the liner hanger; and performing a negative-pressure-test on the liner hanger on the same trip downhole in which the liner hanger is set.

Example 10 is the method of example(s) 9, further comprising: applying weight to the setting control module to control a setting for the test packer; performing a negative-pressure-test on the liner hanger by creating a pressure differential on each side of the test packer; equalizing pressure on each side of the test packer; and removing the test packer, setting control module, and no-go feature from the wellbore.

Example 11 is the method of example(s) 9, further comprising: moving one or more spring-loaded devices from a first configuration where the spring-loaded devices are contained within the stop, to a second configuration where a portion of the spring-loaded devices are external to the stop and engaged with the liner hanger.

Example 12 is the method of example(s) 9, wherein allowing the setting control module to control the test packer includes: applying weight to the setting control module to increase pressure on fluid in a fluid reservoir to overcome a threshold pressure of one or more valves; and allowing the fluid to flow from the fluid reservoir to the test packer to control the setting for the test packer.

Example 13 is the method of example(s) 12, further comprising; removing weight from the setting control module to lower pressure in the fluid reservoir below the threshold pressure to stop the fluid from flowing from the fluid reservoir to the test packer.

Example 14 is the method of example(s) 9, wherein creating a pressure differential on each side of a test packer includes pumping a test fluid with a lower density than fluid present in the wellbore below the test packer.

Example 15 is the method of example(s) 9, further comprising performing a positive-pressure-test comprising: applying weight to the setting control module to increase pressure on fluid in a fluid reservoir to overcome a threshold pressure of one or more valves; allowing the fluid to flow from the fluid reservoir to the test packer to control the setting for the test packer; and pumping fluid down an annulus between a casing and the wellbore to pressurizing an area of the wellbore above the test packer.

Example 16 is a setting control module assembly comprising: a conveyance to transport a setting control module downhole in a wellbore with a liner hanger and tools to position the liner hanger in the wellbore to allow a negative-pressure-test on the liner hanger on the same trip downhole in which the liner hanger is set; a fluid reservoir for receiving a volume of fluid; and one or more valves set to a threshold pressure and fluidly coupleable with a test packer to allow fluid to flow from the fluid reservoir to the test packer to control a setting of the test packer to allow the negative-pressure-test on the liner hanger in response to pressure in the fluid reservoir being greater than or equal to the threshold pressure of the one or more valves.

Example 17 is the setting control module of example(s) 16, wherein the conveyance is controllable to apply a force to the setting control module to increase pressure in the fluid reservoir.

Example 18 is the setting control module of example(s) 16, wherein the test packer is expandable to engage with interior walls of a casing and to form a seal subsequent to the liner hanger being set in the wellbore to allow the negative-pressure-test on the liner hanger on the same trip downhole in which the liner hanger is set.

Example 19 is the setting control module of example(s) 16, wherein the one or more valves are fluidly coupleable with the test packer to allow the fluid to flow from the fluid reservoir to the test packer to control a setting of the test packer to allow a positive-pressure test on the liner hanger.

Example 20 is the setting control module of example(s) 16, wherein the one or more valves are fluidly coupleable with the test packer to prevent fluid from flowing from the fluid reservoir to the test packer to unset the test packer in response to pressure in the fluid reservoir being less than the threshold pressure of the one or more valves.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. An assembly comprising:

a liner hanger having an upper portion with angled interior walls;

a setting control module to control a setting for a test packer, wherein the setting control module comprises:

a fluid reservoir for receiving a volume of fluid; and one or more valves set to a threshold pressure to prevent fluid from exiting the fluid reservoir when the fluid reservoir is at a pressure below the threshold pressure;

the test packer positionable with the liner hanger in a wellbore to allow a negative-pressure-test and a positive-pressure-test on the liner hanger on the same trip downhole in which the liner hanger is set; and a stop to engage with the liner hanger to allow the setting control module to control the test packer, the stop including spring-loaded devices moveable from (i) a retracted position in which the spring-loaded devices are contained within the stop to (ii) an engagement position in which the spring-loaded devices are external to the stop, wherein the spring-loaded devices are configured to move from the retracted position to the engagement position and engage with the upper portion of the liner hanger prior to the negative-pressure-test and the positive-pressure-test and disengage with the upper portion of the liner hanger after the negative-pressure-test and the positive-pressure-test.

2. The assembly of claim 1, wherein the liner hanger comprises a polished bore receptacle (PBR) or a tieback receptacle (TBR) for engaging with the stop.

3. The assembly of claim 1, further comprising a conveyance coupled with the setting control module, wherein a weight of the conveyance is usable to increase the pressure in the fluid reservoir.

4. The assembly of claim 1, wherein the one or more valves are operable to allow fluid from the fluid reservoir to travel to the test packer in response to a pressure in the fluid reservoir being at or above the threshold pressure.

5. The assembly of claim 1, wherein the test packer is expandable to engage with interior walls of a casing and to form a seal subsequent to the liner hanger being set in the wellbore to allow the negative-pressure-test on the liner hanger on the same trip downhole in which the liner hanger is set.

6. The assembly of claim 1, further comprising running tools for positioning the liner hanger in the wellbore to allow the negative-pressure-test on the liner hanger on the same trip downhole in which the liner hanger is set.

7. A method comprising:

setting a liner hanger in a wellbore using a conveyance on which a setting control module and a test packer are coupled, the liner hanger having an upper portion with angled interior walls, wherein the setting control module comprises a fluid reservoir for receiving a volume of fluid and one or more valves set to a threshold pressure to prevent fluid from exiting the fluid reservoir when the fluid reservoir is at a pressure below the threshold pressure;

allowing the setting control module to control the test packer by a stop engaging the liner hanger such that the pressure of the fluid reservoir exceeds the threshold pressure, the stop engaging the liner hanger by moving one or more spring-loaded devices from (i) a first configuration where the one or more spring-loaded devices are contained within the stop to (ii) a second configuration where the one or more spring-loaded devices are external to the stop, wherein in the second configuration, the spring-loaded devices are angled relative to the stop to engage with the angled interior walls of the upper portion of the liner hanger;

performing a positive-pressure-test on the liner hanger on the same trip downhole in which the liner hanger is set;

disengaging the stop from the liner hanger by moving the one or more spring-loaded devices from the second configuration to the first configuration;

engaging the stop by moving the one or more spring-loaded devices from the first configuration to the second configuration;

performing a negative-pressure-test on the liner hanger on the same trip downhole in which the liner hanger is set; and disengaging the stop from the liner hanger by moving the one or more spring-loaded devices from the second configuration to the first configuration.

8. The method of claim 7, further comprising:

performing the negative-pressure-test on the liner hanger by creating a pressure differential on each side of the test packer;

equalizing pressure on each side of the test packer; and removing the test packer, the setting control module, and the stop from the wellbore.

9. The method of claim 7, wherein allowing the setting control module to control the test packer includes:

applying weight to the setting control module to increase the pressure on the fluid in the fluid reservoir to overcome the threshold pressure of the one or more valves; and allowing the fluid to flow from the fluid reservoir to the test packer to control the setting for the test packer.

10. The method of claim 9, further comprising:

removing weight from the setting control module to lower the pressure in the fluid reservoir below the threshold pressure to stop the fluid from flowing from the fluid reservoir to the test packer.

11. The method of claim 7, wherein creating a pressure differential on each side of the test packer includes pumping a test fluid with a lower density than fluid present in the wellbore below the test packer.

12. The method of claim 7, wherein performing a positive-pressure-test comprises:

applying weight to the setting control module to increase pressure on the fluid in the fluid reservoir to overcome the threshold pressure of the one or more valves;

allowing the fluid to flow from the fluid reservoir to the test packer to control the setting for the test packer; and pumping fluid down an annulus between a casing and the wellbore to pressurize an area of the wellbore above the test packer.

13. A setting control module assembly comprising:

a conveyance to transport a setting control module downhole in a wellbore with a liner hanger, a stop, and tools to position the liner hanger in the wellbore to allow a negative-pressure-test and a positive-pressure-test on the liner hanger on the same trip downhole in which the liner hanger is set, wherein the stop includes spring-loaded devices moveable from (i) a retracted position in which the spring-loaded devices are contained within the stop to (ii) an engagement position in which the spring-loaded devices are external to the stop, wherein the spring-loaded devices are configured to move from the retracted position to the engagement position and engage with an upper portion of the liner hanger prior to the negative-pressure-test and the positive-pressure-test and disengage with the upper portion of the liner hanger after the negative-pressure-test and the positive-pressure-test;

a fluid reservoir for receiving a volume of fluid; and one or more valves set to a threshold pressure and fluidly coupleable with a test packer to prevent fluid from exiting the fluid reservoir when a pressure of the fluid reservoir is below the threshold pressure and to allow the fluid to flow from the fluid reservoir to the test packer when the pressure of the fluid reservoir exceeds the threshold pressure to control a setting of the test packer to allow the negative-pressure-test on the liner hanger in response to pressure in the fluid reservoir being greater than or equal to the threshold pressure of the one or more valves.

14. The setting control module assembly of claim 13, wherein the conveyance is controllable to apply a force to the setting control module to increase the pressure in the fluid reservoir.

15. The setting control module assembly of claim 13, wherein the test packer is expandable to engage with interior walls of a casing and to form a seal subsequent to the liner hanger being set in the wellbore to allow the negative-pressure-test on the liner hanger on the same trip downhole in which the liner hanger is set.

16. The setting control module assembly of claim 13, wherein the one or more valves are fluidly coupleable with the test packer to allow the fluid to flow from the fluid reservoir to the test packer to control a setting of the test packer to allow a positive-pressure test on the liner hanger.

17. The setting control module assembly of claim 13, wherein the one or more valves are fluidly coupleable with the test packer to prevent fluid from flowing from the fluid reservoir to the test packer to unset the test packer in response to the pressure in the fluid reservoir being less than the threshold pressure of the one or more valves.

* * * * *